US008622642B2

(12) United States Patent
Kim

(10) Patent No.: US 8,622,642 B2
(45) Date of Patent: Jan. 7, 2014

(54) ONE HAND LIP STICK

(76) Inventor: Tae Jin Kim, Middletown, CT (US)

( * ) Notice: Subject to any disclaimer, the term of this patent is extended or adjusted under 35 U.S.C. 154(b) by 580 days.

(21) Appl. No.: 12/911,926

(22) Filed: Oct. 26, 2010

(65) Prior Publication Data

US 2012/0099916 A1 Apr. 26, 2012

(51) Int. Cl.
*B43K 5/16* (2006.01)

(52) U.S. Cl.
USPC ..... 401/108; 401/107

(58) Field of Classification Search
USPC ..... 401/107, 108
See application file for complete search history.

(56) References Cited

U.S. PATENT DOCUMENTS

| | | | | |
|---|---|---|---|---|
| 2,386,417 | A | 10/1945 | Apfelbaum | |
| 2,486,073 | A | 10/1949 | Dann | |
| 2,513,830 | A | 7/1950 | Voegeli | |
| 2,644,577 | A | 7/1953 | Orenick | |
| 3,612,072 | A | 10/1971 | Fukui | |
| 3,617,138 | A | 11/1971 | Fukui | |
| 4,973,178 | A | 11/1990 | Kakuta et al. | |
| 5,171,096 | A | 12/1992 | Perrotti | |
| 5,423,622 | A | 6/1995 | Perrotti | |
| 5,890,826 | A | 4/1999 | Kim | |
| 5,904,431 | A | 5/1999 | Terruzzi | |
| 5,979,468 | A | 11/1999 | Blake, III | |
| 6,056,465 | A | 5/2000 | Kuo | |
| 6,588,959 | B1 * | 7/2003 | Kuo | 401/108 |
| 8,152,398 | B2 * | 4/2012 | Kim et al. | 401/108 |

* cited by examiner

*Primary Examiner* — David Walczak
(74) *Attorney, Agent, or Firm* — LRK Patent Law Firm

(57) ABSTRACT

A one hand lipstick container includes: a container main body having a cylinder standing at the center of a body and a center through-hole; a container cover rotatably connected to the upper portion of the container main body and having an open inlet; a cover holder combined by a spiral with the outer side of the cylinder of the container main body and vertically moving up/down by rotational force of the container cover; a door hinged to the cover holder to open/close the upper portion of the cover holder; a lipstick housing combined by a spiral with the inner side of the center through-hole of the container main body and vertically moved up/down by rotational force of the cover holder; and a vertical guide transmitting the rotational force of the cover holder to the lipstick housing and vertically guiding the lipstick housing to move up/down.

18 Claims, 6 Drawing Sheets

ONE HAND LIP STICK

BACKGROUND

1. Field of the Invention

The present invention relates to a lipstick container, in detail, a one hand lipstick container that can be used by one hand.

2. Description of the Related Art

In general, lipsticks are necessities that most women carry. Although most women put on a lipstick in the house to go outside, they put on a lipstick at the outside also in many cases. Therefore, lipsticks should be easy to carry and use.

Containers for the lipsticks are formed such that a container main body and a container cover are separated, such that users had to use the lipstick with one hand while holding the container cover with other hand.

The structure of existing lipstick containers known in the art is described below.

Lipstick containers are composed of a cylinder with a vertical groove standing in a container main body, a lipstick holder inserted in the container main body, an outer container surrounding the outer side of the cylinder in the container main body, and a cover have been widely known.

The lipstick containers of the related art are beautiful because there is no protrusion on the container containing the lipstick, give elegant feeling because they turn, and can make it possible to reduce the manufacturing cost and time because the number of parts is small; however, it is necessary to use both hands to open the cap and turn the lower portion of the containers.

Further, the lipstick containers in the related art have a problem in that the lipstick is mashed and cannot be used, when the cover is closed, with the lipstick not fully inserted in the container.

Researches for developing a lipstick container that can be used by one hand have been conducted to increase portability and convenience of the lipstick container.

As a related art having the above object, there is a lipstick container that is operated by rotating the container main body, without using a cap, which is as follows.

First, a lipstick container including a plate covering the upper portion of the container and a device opening the plate has been proposed (U.S. Pat. No. 6,056,465). However, the above relate art has a problem in that it is not good in appearance because the plate remains on the outer side of the container when the plate opens an opening.

Further, although other technologies for inserting plates in containers have been know in the related art, there are problems in that the external appearance is deteriorated by a portion of a plate protruding outside (U.S. Pat. Nos. 5,423,622, 2,386,417, 5,979,468, 2,486,073, 3,617,138, and 3,612,072), a plate is made of a flexible material, such that stability is reduced (U.S. Pat. Nos. 2,644,577, 5,890,826, and 5,904,431), it is difficult to produce and assemble in large quantities due to too many parts, or there is high probability that defective products will be made in assemblage (U.S. Pat. No. 5,171,096).

Further, a technology that uses a protrusion for operation, such as a handle, outside the container main body (U.S. Pat. Nos. 2,513,830 and 4,973,178). Since these technologies in the related art use new methods for users, not the existing methods, there is a problem in that these may repel consumers or give them inconvenience.

SUMMARY

In order to overcome the above problems, it is an object of the present invention to provide a one hand lipstick container that can be easily operated and used by one hand.

It is another object of the present invention to provide a one-hand lipstick container that can be designed to have an elegant external appearance by assembling all the part in a container cover and a container main body such that the parts are not exposed to the outside.

It is another object of the present invention to provide a one-hand lipstick container that can be used by rotating the container main body, similar to existing lipstick containers.

It is another object of the present invention to provide a one-hand lipstick container in which the height of the container main body is optimized such that a user can take all action with the lipstick container in one hand.

An aspect of the present invention provides a one hand lipstick container in which wherein an inner spiral guide groove and an outer spiral guide groove are formed at a cylinder of a container main body, in opposite directions, a lipstick housing is disposed to move up/down along the inner spiral guide groove when the container main body rotates, and a door is opened or closed by up-down movement in the opposite direction to the lipstick housing along the outer spiral guide groove.

Another aspect of the present invention provides a one hand lipstick container including: a container body having a cylinder standing at the center of a body and a center through-hole formed through the center of the cylinder; a container cover rotatably connected to the upper portion of the container main body and having an open inlet formed through the top; a vertical guide having a fixed end combined with the upper portion of the container cover and a pipe extending down to be rotatably fitted in the center through-hole of the container main body; a lipstick housing inserted in the pipe of the vertical guide and vertically moving up/down along a slide guide formed in the pipe; a cover holder disposed between one side of the fixed end of the vertical guide and the inner side of the container to vertically slide and vertically moving up/down along the outer spiral guide groove on the cylinder of the container main body; and a door hinged to the upper end of the cover holder and operating with the up-down movement to open/close the inlet of the container cover.

The container main body may have the outer spiral guide groove on the outer side of the cylinder such that the cover holder spirally rotates and moves up/down and the inner spiral guide groove on the inner side of the cylinder such that the lipstick housing spirally rotates and moves up/down.

Further, the container cover rotatably may be connected to the upper portion of the container cover and have the inlet open at the top and a door guide groove guiding a top close path of the door operating with up-down movement of the cover holder, in the inner side Further, the vertical guide may have a pipe fitted in the center through-hole of the container main body and a fixed end extending from the top of the pipe to be combined with the container cover, with the cover holder movable up/down on one side.

The pipe may have a slide groove formed vertically long at one side to guide the guide protrusion of the lipstick container.

Further, the lipstick housing may have a cylindrical housing body where a lipstick is received, and a guide protrusion may be formed on the outer side of the housing body to be spirally inserted in the inner spiral guide groove Further, the cover holder may have a base plate being in contact with one side of the fixed end of the vertical guide to slide up/down, a pipe-fitting portion extending in a ring shape from the lower end of the base plate to cover the outer side of the cylinder of the container main body, a door hinge portion formed at the upper end of the base plate such that the door is hinged, and an outer rotational protrusion formed on the inner side of the lower end of the base plate to be spiral-combined with the outer spiral guide groove of the cylinder.

Further, the door has one end hinged to a door hinge portion of the cover holder and the other end fitted between a door guide groove on the inner side of the container cover and a door guide groove at the vertical guide, to be guided along an open path.

Further, the inner spiral guide groove and the outer spiral guide groove may be formed in the opposite directions on the cylinder of the container main body.

Further, the pitch of an outer spiral guide groove formed on the outer side of the cylinder of the container main body may not be uniform.

The pitch of the outer spiral guide groove may be formed wide at an upper section and relatively narrow at a lower section Further, a cylinder member may be provided to cover the lipstick housing and move up/down before the lipstick housing moves up/down.

A guide protrusion inserted in the inner spiral guide groove of the cylinder of the container main body may be formed at the lower end of the cylinder member and a protrusion groove where the guide protrusion of the lipstick housing is inserted may be formed under the guide protrusion The present invention having the configurations described above makes it possible to use the lipstick container with one hand, such that the use is simple and a good appearance is provided.

Further, since all the parts are assembled in the container cover and the container main body and the parts are not exposed to the outside, it is possible to make the external appearance of the lipstick container in an elegant design. In addition, since the lipstick container is used by turning the container main body, similar to existing lipstick containers, users can familiarly use it, without strangeness.

Further, according to the present invention, by optimizing the height of the container main body such that a user can take all action with the lipstick container in one hand, it is possible to easily rotate the container cover with fingers while gripping the container main body with the palm, such that the use is convenient.

Further, the container main body and the container cover of the lipstick container of the present invention can be made of high-strength synthetic resin, metal, or ceramic, and when it is made of metal, such as aluminum, it is possible to achieve a high-quality product due to the peculiar metallic luster and the textural expression. Further, since it is possible to reduce the thickness of the parts, it is possible to reduce the entire size of the product and implement more refined product image.

DETAILED DESCRIPTION OF THE PREFERRED EMBODIMENTS

Exemplary embodiments of the present invention are described hereafter in detail with reference to the accompanying drawings.

Figure 1:
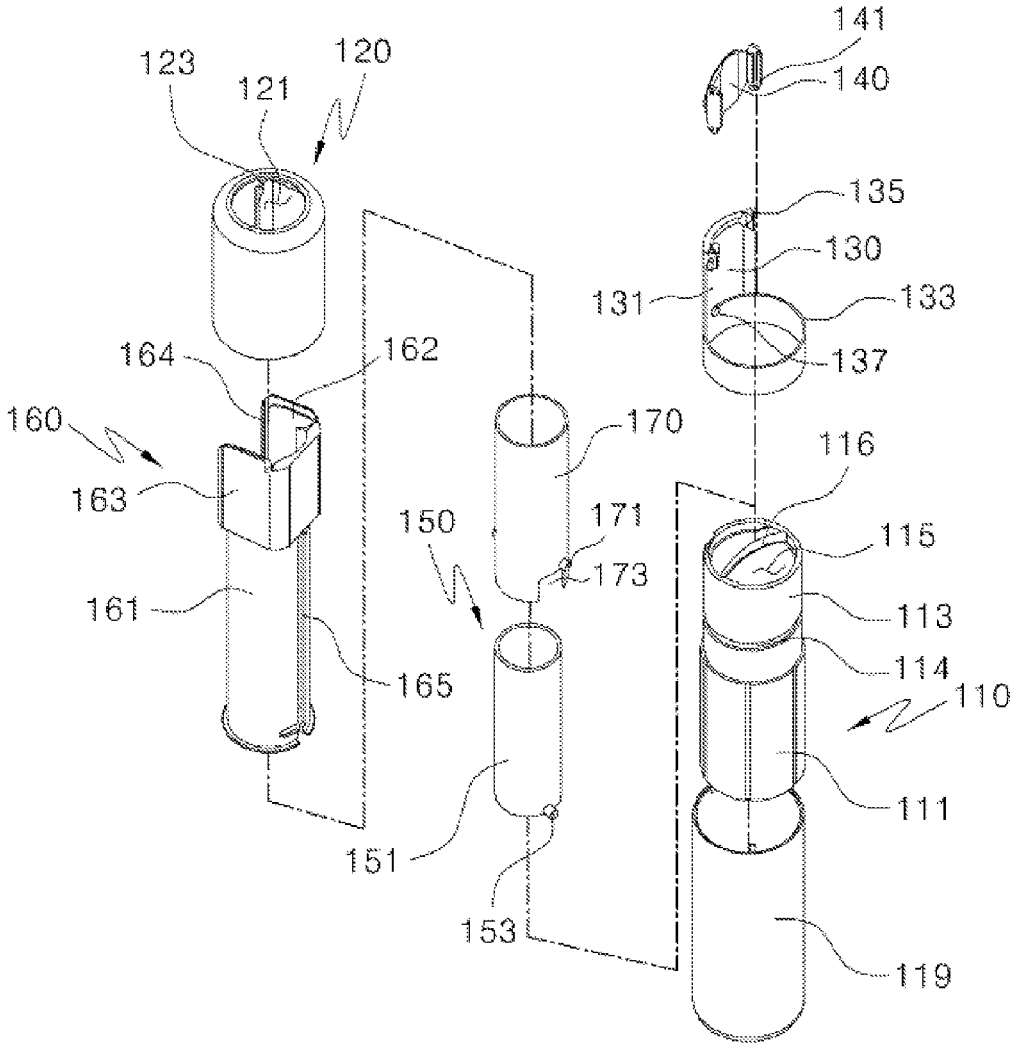
FIG. 1 is an exploded perspective view of a one hand lipstick container according to an embodiment of the present invention.

FIG. 1 is an exploded perspective view of a one hand lipstick container according to an embodiment of the present invention.

Referring to FIG. 1, a one hand lipstick container according to an embodiment of the present invention includes a container main body 110, a container cover 120, a cover holder 130, a door 140, a lipstick housing 150, and a vertical guide 160.

The container main body 110 is described first in detail hereafter.

In the container main body 110, a cylinder 113 stands at the center of a body 111 and a center through-hole 115 is formed through the center of the cylinder 113.

The body 111 supporting the cylinder 113 may be formed in various shapes and FIG. 1 shows a cylindrical shape as an example.

Further, it is possible to improve the aesthetic appearance of the body 111 by combining a case 119 made of a specific material.

Figure 2A:
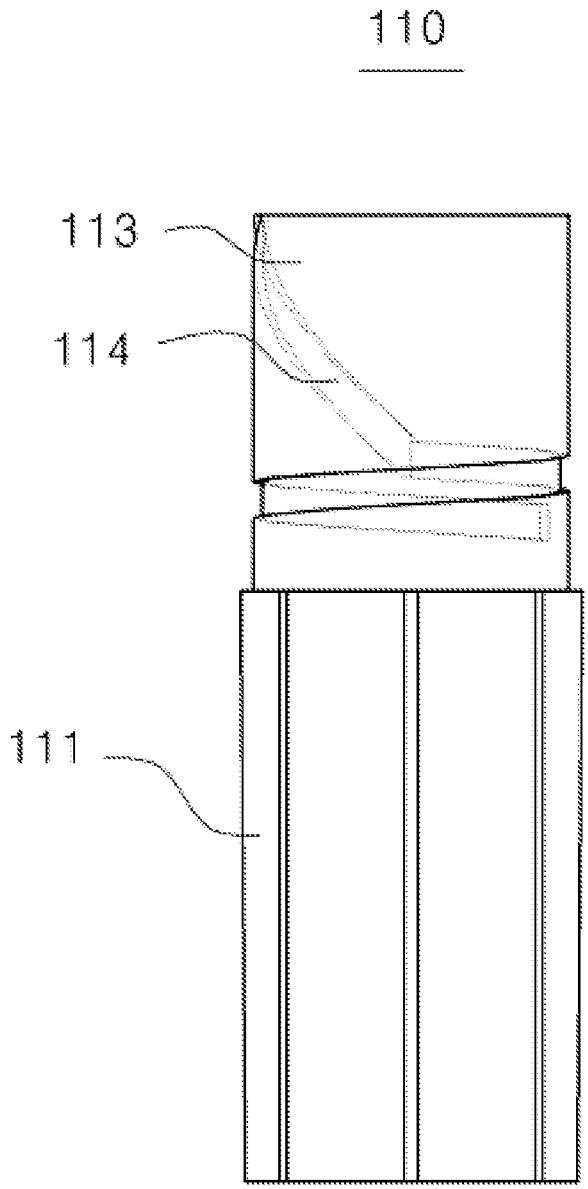
FIGS. 2A and 2B are front views of the container main body of the one hand lipstick container according to an exemplary embodiment of the present invention.
Figure 2B:
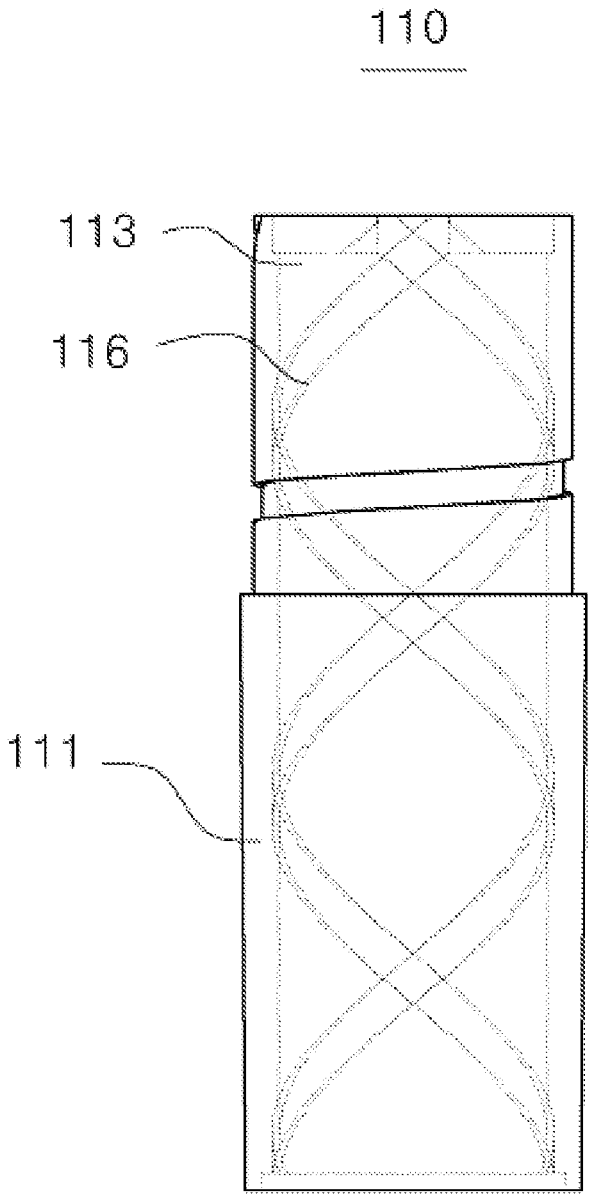

FIGS. 2A and 2B are front views of the container main body of the one hand lipstick container according to an exemplary embodiment of the present invention.

Referring to FIG. 2A, the cylinder 113 has an outer spiral guide groove 114, in which the outer spiral guide groove 114 guides the cover holder 130, which is combined by a spiral, to rotate upward/downward.

Referring to FIG. 2B, the center through-hole 115 in the cylinder 113 is connected to the bottom of the body 111 and has an inner spiral guide groove 116, in which the inner spiral guide groove 116 guides the lipstick housing 150 (described below) which is combined by a spiral, to rotate upward/downward.

In this configuration, the center through-hole 115 of the container main body 110 is an integral through-hole having the same inner diameter from the top of the cylinder 113 to the bottom of the body 111.

The container cover 120 is described in detail hereafter.

Referring to FIG. 1, the container cover 120 is rotatably connected to the upper portion of the container main body 110 and has an open inlet 121 formed through the top.

The inlet 121 allows the lipstick in the lipstick housing 150, which is combined with to move up/down, to protrude outside and is opened or closed by the door 140 operatively combined with the cover holder 130.

A door guide groove 123 that guides the top opening/closing-path of the door 140 in accordance with the ascent/descent of the cover holder 130 is formed on the inner side of the container cover 120.

In this configuration, the container cover 120 may be formed in various shapes, including a circle, a polygon, or combinations of them, and FIG. 1 shows a cylindrical shape as an example.

The container cover 120 equipped with the vertical guide 160 that is rotatably fitted in the center through-hole 115 of the container main body 100 to guide the lipstick housing 150 rotating and moving up/down.

The vertical guide 160 is described in detail hereafter.

Figure 3:
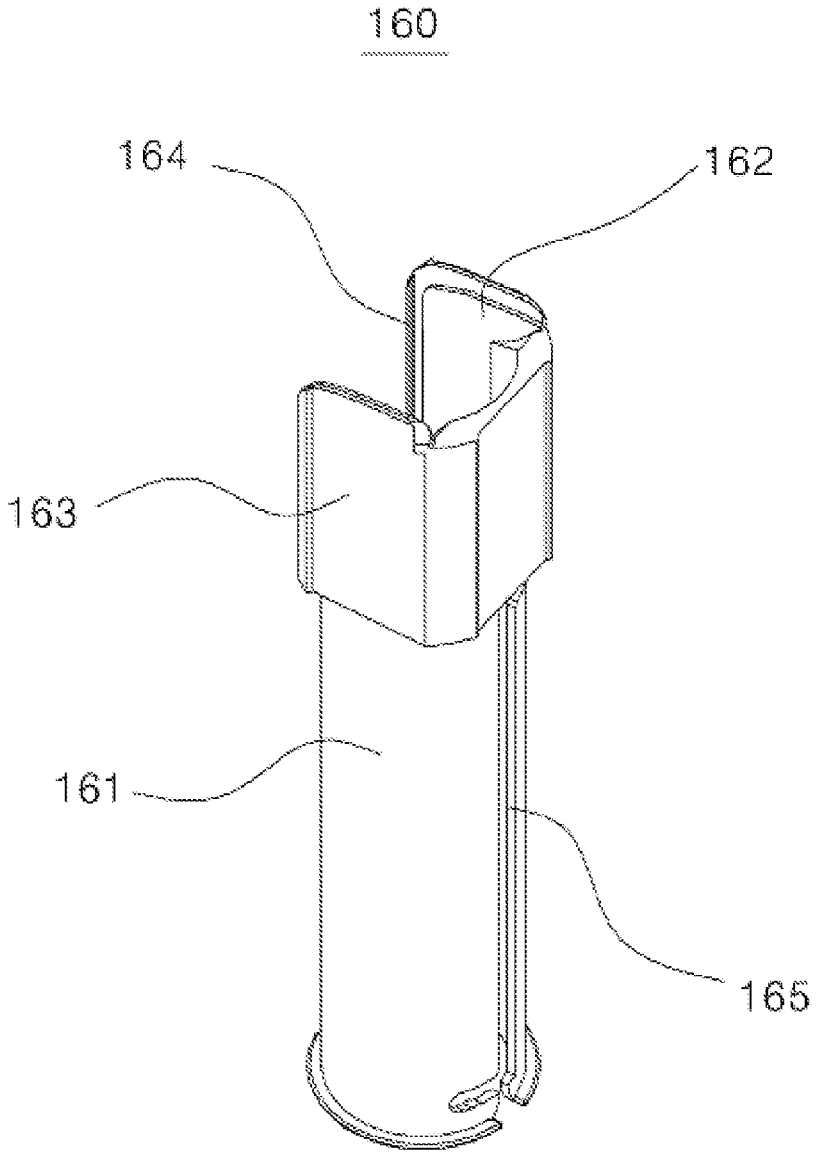
FIG. 3 is a perspective view showing the vertical guide of the one hand lipstick container according to an exemplary embodiment of the present invention.

FIG. 3 is a perspective view showing the vertical guide of the one hand lipstick container according to an exemplary embodiment of the present invention.

Referring to FIG. 3, the vertical guide 160 of the present invention transmits the rotational force of the container cover 120 to the lipstick housing 150 disposed in the center through-hole 115 and guides the lipstick housing 150 to move up/down in the opposite directions to the cover holder 130.

The vertical guide 160 is composed of a pipe 161 fitted in the center through-hole 115 of the container main body 110 and a fixed end 163 extending from the top of the pipe 161 to be combined with the container cover 120, with the cover holder 130 movable up/down on one side.

The lipstick housing 150 is disposed in the pipe 161 to be movable up/down.

A slide groove 165 is formed vertically long on one side of the pipe 161 such that the lipstick housing 150 can vertically move up/down and a guide protrusion 153 formed at the lower portion of the lipstick housing 150 is inserted in the slide groove 165.

The guide protrusion 153 of the lipstick housing 150 protrudes outside through the slide groove and is seated in the inner spiral guide groove 116 of the container main body 110.

That is, the vertical guide 160 with the fixed end 163 in the container cover 120 rotates with the container cover 120 and transmits the rotational force of the container cover to the lipstick housing 150.

The lipstick housing 150 rotates with the vertical guide 160 by means of the rotational force and vertically moves up/down along the slide groove 165 of the vertical guide 160 by the guide protrusion 153 that revolves along the inner spiral guide groove 116.

The lipstick housing 150 is described in detail hereafter.

Referring to FIG. 1, the lipstick housing 150 is spiral-combined with the container main body 110 by the inner spiral guide groove 116 formed on the center through-hole 115 of the container main body 110 to move up/down, and has a cylindrical housing body 151 where the lipstick is received and the guide protrusion 153 that protrudes on the outer side of the housing body 151 to be fitted in the inner spiral guide groove 116.

The lipstick housing 150 rotates with the cover holder 120 by the vertical guide 160 and vertically moves up/down in accordance with the rotational direction.

The cover holder 130 that operates in the opposite direction to the lipstick housing 150, that is, moves down with moving-up of the lipstick housing 150 and moves up with moving-down of the lipstick housing 150 is positioned between the fixed end 163 of the vertical guide 160 and the container cover 120.

The cover holder 130 is described first in detail hereafter.

Figure 4:
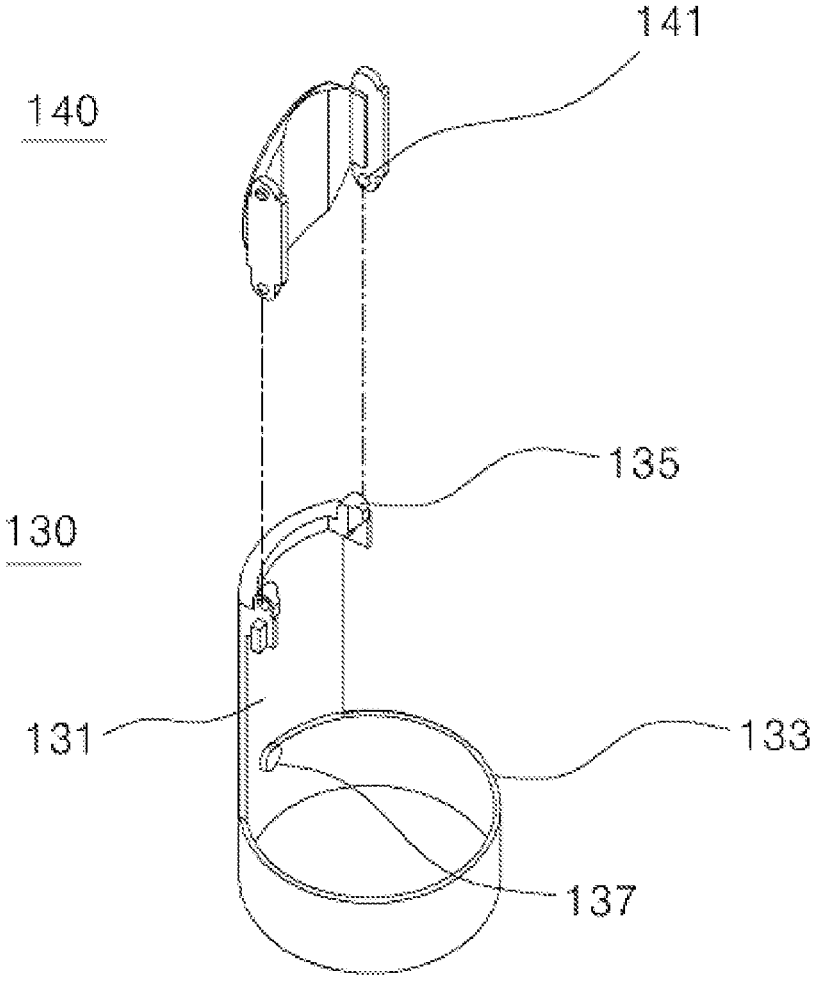
FIG. 4 is a perspective view showing the door and the cover holder of the one hand lipstick container according to an exemplary embodiment of the present invention.

FIG. 4 is a perspective view showing the door and the cover holder of the one hand lipstick container according to an exemplary embodiment of the present invention.

Referring to FIG. 4, the cover holder 130 of the present invention is composed of a base plate 131 being in contact with one side of the fixed end 163 of the vertical guide 160 to slide up/down, a pipe-fitting portion 133 extending in a ring shape from the lower end of the base plate 131 to cover the outer side of the cylinder 113 of the container main body 110, a door hinge portion 135 formed at the upper end of the base plate 131 such that the door 140 is hinged, and an outer rotational protrusion 137 formed on the inner side of the lower end of the base plate 131 to be spiral-combined with the outer spiral guide groove 114 of the cylinder 113.

The cover holder 130 having this configuration rotates with the vertical guide 160 when the container cover 120 rotates, in which the outer rotational protrusion 137 at the lower end of the base plate revolves along the outer spiral guide groove 114 of the cylinder 113, thereby changing the vertical position.

The base plate 131 of the cover holder 130 is slidably fitted in a vertical guide portion 164 of the vertical guide 160 to be vertically guided up/down.

The door 140 is hinged to the upper end of the cover holder 130 to open/close the inlet 121 of the container cover 120 by the moving-up/down of the cover holder 130.

The door 140 is described in detail hereafter.

Referring to FIG. 4 the door 140 is combined to open/close the inlet 121 of the container cover 120, with one end hinged to the door hinge portion 135 of the cover holder 130 and the other end between a door guide groove 123 on the inner side of the container cover 120 and a door guide groove 162 at the vertical guide 160, to be guided along an open path.

As the cover holder 130 moves down, the end of the door 140 hinged to the cover holder 130 moves down, and at the same time, the opposite end moves along the open path of the door guide grooves 123, 162, such that the inlet 121 of the container cover 120 is opened.

The door 140 is horizontally smoothly opened while the cover holder 130 moves down, and the door 140 vertically stands and stop moving down when the cover holder 130 fully moves down, that is, the inlet 121 is fully opened, which corresponds to the final lower position of the cover holder 130.

On the contrary, as the cover holder 130 moves up, the door 140 moves along the close path of the door guide groove 123, such that the inlet 121 of the container cover 120 is closed.

The up-down movement of the cover holder 130 is made by the rotational force of the container cover 120, in the opposite directions to the up-down movement of the lipstick housing 150.

The inner spiral guide groove 116 and the outer spiral guide groove 114 of the cylinder 113 of the cover main body 110 are formed in the opposite direction to achieve the above configuration.

The operation of the one hand lipstick container according to an exemplary embodiment of the present invention is described hereafter.

First, a user rotates the container cover 120 with fingers, with the container body 110 in one hand.

In this operation, the vertical guide 160 and the cover holder 130 combined with the container main body 110 are correspondingly rotated and the cover holder 130 moves down while rotating along the outer spiral guide groove 114 on the cylinder 113.

In this operation, the cover holder 130 vertically moves down along the inner side of the container cover 120, with the door 140 hinged to the cover holder 130.

Further, the opposite end of the door 140 moves along the open path of the door grooves 123, 162 and opens the inlet 121 of the container cover 120.

As the inlet 121 is fully opened, the door vertically stands 140 and stop moving down.

In this operation, the cover holder 130 moves down while the lipstick housing 150 moves up, in which since the lipstick housing 150 receives the rotational force of the container cover 120 through the vertical guide 160, they move up/down along the inner spiral guide groove 116.

The lipstick housing 150 receiving the rotational force from the vertical guide 160 moves up/down along the inner spiral guide groove 116, in the opposite direction to the cover holder 130, that is, vertically moves up/down along the slide groove 165 of the vertical guide 160.

The lipstick in the lipstick housing 150 protrudes through the open inlet 121 of the container cover 120 and the user can make up with the lipstick.

One of the important features of the present invention is that the lipstick housing 150 is slowly moved up after the cover holder 130 and the door 140 are opened first.

For this operation, according to the mechanism of the present invention, as shown in FIG. 2A, it is possible to non-uniformly form the pitch of the outer spiral guide groove 114 on the outer side of the cylinder 113, and for example, it is possible to make wide the pitch of the upper section in the entire section and relatively narrow the pitch of the lower section.

As described above, the reason that the pitch of the outer spiral guide groove 114 is non-uniform is because the descent section of the cover holder 130 is relatively shorter than the ascent section of the lipstick housing 150, which is for continuing the rotation while the lipstick housing 150 move up to the highest position, by narrowing the pitch such that the lipstick housing rapidly moves down in the upper section of the outer spiral groove 114 to open the inlet 121 of the container cover 120 and then slowly moves down in the lower section.

Further, the present invention may be implemented by a structure opposite to the structure described above. That is, it is also possible to non-uniformly form the pitch of the inner spiral guide groove 116, in which the pitch is set small at the lower section such that the lipstick housing move up/sown slow while waiting for the opening timing of the door 140, and the pitch is set large after the door 140 is opened such that it can rapidly move up/down.

Figure 5:
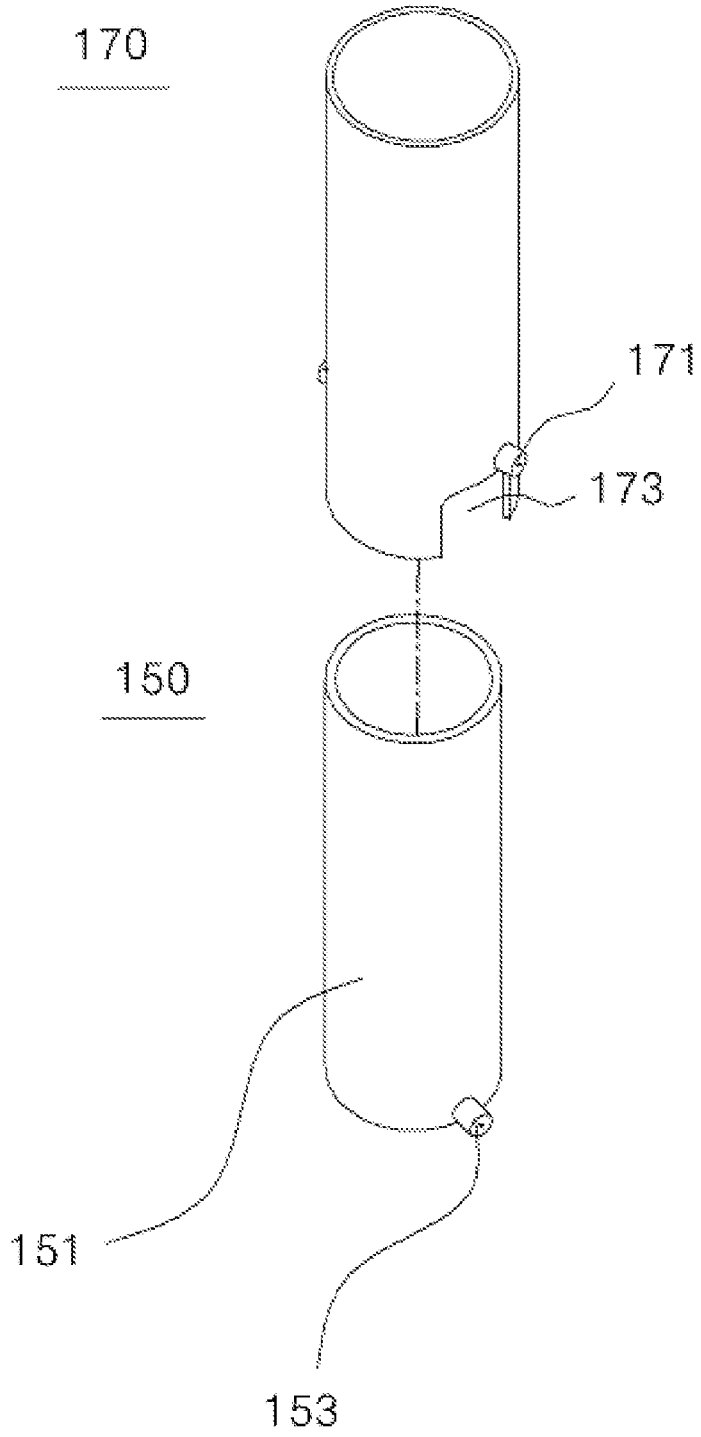
FIG. 5 is a perspective view showing an installation structure of the cylinder member of the one hand lipstick container according to an exemplary embodiment of the present invention.

Further, according to the present invention, it is possible, as shown in FIG. 5, to a cylinder member 170 moves up/down before the lipstick housing 150 moves up/down, by positioning the cylinder member 170 to cover the lipstick housing 150.

FIG. 5 is a perspective view showing an installation structure of the cylinder member of the one hand lipstick container according to an exemplary embodiment of the present invention.

Referring to FIG. 5, the cylinder member 170 can be disposed to cover the lipstick housing 150. A guide protrusion 171 inserted in the inner spiral guide groove 115 of the cylinder 113 of the container main body 110 is formed at the lower end of the cylinder member 170 and a protrusion groove 173 where the guide protrusion 153 of the lipstick housing 150 is inserted is formed under the guide protrusion 171.

The cylinder member 170 is formed in a pipe shape and moves up first to the uppermost portion of the center through-hole 115 to protrude through the inlet 121 of the container cover 120 before the lipstick housing 150 moves up, and then the lipstick housing 150 moves up second over the cylinder member 170 such that the lipstick protrudes.

This is for preventing a problem that the door 140 interferes with the lipstick.

Although it is possible to manufacture the container main body and the container cover of the lipstick container of the present invention described above with synthetic resin, metal, or ceramic, when they are made of metal, such as aluminum, it is possible achieve a high-quality product due to the peculiar metallic luster and the textural expression.

In particular, using metal can decrease the thickness of the product, such that it is possible to decrease the entire size of the product, which contributes to refine the image of the product.

Further, the present invention having the configurations described above makes it possible to use the lipstick container with one hand, such that the use is simple and a good aesthetic appearance is achieved.

Further, since all the parts are assembled in the container cover and the container main body and the parts are not exposed to the outside, elegant design can be accomplished even if the lipstick container is manufactured to have the same external appearance as existing lipstick containers. In addition, since the lipstick container is used by rotating the container main body, similar to existing lipstick containers, users can familiarly use it, without strangeness.

Further, according to the present invention, by optimizing the height of the container main body such that a user can take all action with the lipstick container in one hand, it is possible to easily rotate the container cover with fingers while gripping the container main body with the palm, such that the use is convenient.

What is claimed is:

1. A one hand lipstick container, wherein an inner spiral guide groove and an outer spiral guide groove are formed at a cylinder of a container main body in opposite directions, a lipstick housing is disposed to move up/down along the inner spiral guide groove when a container cover rotates, and a door is opened or closed by up-down movement in the opposite direction to the direction of movement of the lipstick housing along the outer spiral guide groove, and wherein the door has one end hinged to a dogs hinge portion of a cover holder and another end fitted between a door guide groove on an inner side of the container cover and a door guide groove at a vertical guide, to be guided along an open path.

2. A one hand lipstick container comprising:

a container body having a cylinder standing at a center of a body and a center through-hole formed through a center of the cylinder;

a container cover rotatably connected to an upper portion of the container main body and having an open inlet formed through a top thereof;

a vertical guide having a fixed end combined with an upper portion of the container cover and a pipe extending down to be rotatably fitted in the center through-hole of the container main body;

a lipstick housing inserted in the pipe of the vertical guide and vertically moving up/down along a slide groove formed in the pipe;

a cover holder disposed between one side of the fixed end of the vertical guide and an inner side of the container to vertically slide and vertically moving up/down along an outer spiral guide groove on the cylinder of the container main body; and a door hinged to an upper end of the cover holder and operating with the up-down movement to open/close the inlet of the container cover, wherein the door has one end hinged to a door hinge portion of the cover holder and another end fitted between a door guide groove on the inner side of the container cover and a door guide groove at the vertical guide, to be guided along an open path.

3. The one hand lipstick container according to claim 2, wherein the container cover is connected to the upper portion of the container main body and has the inlet open at the top and a door guide groove guiding the door operating with up-down movement of the cover holder, in the inner side of the container cover.

4. The one hand lipstick container according to claim 2, wherein the fixed end extends from a top of the pipe to be combined with the container cover, with the cover holder movable up/down on one side of the fixed end.

5. The one hand lipstick container according to claim 4, wherein the pipe has the slide groove formed vertically long at one side to guide a guide protrusion of the lipstick housing.

6. The one hand lipstick container according to claim 2, wherein the cover holder has a base plate being in contact with one side of the fixed end of the vertical guide to slide up/down, a pipe-fitting portion extending in a ring shape from a lower end of the base plate to cover an outer side of the cylinder of the container main body, a door hinge portion formed at an upper end of the base plate such that the door is hinged, and an outer rotational protrusion formed on an inner side of the lower end of the base plate to be spiral-combined with the outer spiral guide groove of the cylinder.

7. The one hand lipstick container according to claim 2, wherein the container main body has the outer spiral guide groove on an outer side of the cylinder such that the cover holder spirally rotates and moves up/down and an inner spiral guide groove on an inner side of the cylinder such that the lipstick housing spirally rotates and moves up/down.

8. The one hand lipstick container according to claim 7, wherein a pitch of the outer spiral guide groove formed on the outer side of the cylinder of the container main body is not uniform.

9. The one hand lipstick container according to claim 8, wherein the pitch of the outer spiral guide groove is formed wide at an upper section and relatively narrow at a lower section.

10. The one hand lipstick container according to claim 7, wherein a cylinder member is provided to cover the lipstick housing and moves up/down before the lipstick housing moves up/down.

11. The one hand lipstick container according to claim 10, wherein a guide protrusion inserted in the inner spiral guide groove of the cylinder of the container main body is formed at a lower end of the cylinder member and a protrusion groove where a guide protrusion of the lipstick housing is inserted is formed under the guide protrusion inserted in the inner spiral guide groove of the cylinder.

12. The one hand lipstick container according to claim 2, wherein the lipstick housing has a cylindrical housing body where a lipstick is received, and a guide protrusion is formed on an outer side of the housing body to be spirally inserted in an inner spiral guide groove.

13. The one hand lipstick container according to claim 1, wherein the container main body has the outer spiral guide groove on an outer side of the cylinder such that the cover holder spirally rotates and moves up/down and the inner spiral guide groove on an inner side of the cylinder such that the lipstick housing spirally rotates and moves up/down.

14. The one hand lipstick container according to claim 13, wherein a pitch of the outer spiral guide groove formed on the outer side of the cylinder of the container main body is not uniform.

15. The one hand lipstick container according to claim 14, wherein the pitch of the outer spiral guide groove is formed wide at an upper section and relatively narrow at a lower section.

16. The one hand lipstick container according to claim 13, wherein a cylinder member is provided to cover the lipstick housing and moves up/down before the lipstick housing moves up/down.

17. The one hand lipstick container according to claim 16, wherein a guide protrusion inserted in the inner spiral guide groove of the cylinder of the container main body is formed at a lower end of the cylinder member and a protrusion groove where a guide protrusion of the lipstick housing is inserted is formed under the guide protrusion inserted in the inner spiral guide groove of the cylinder.

18. The one hand lipstick container according to claim 1, wherein the lipstick housing has a cylindrical housing body where a lipstick is received, and a guide protrusion is formed on an outer side of the housing body to be spirally inserted in the inner spiral guide groove.

* * * * *